United States Patent [19]

Zeuner et al.

[11] Patent Number: 4,651,118

[45] Date of Patent: Mar. 17, 1987

[54] PROPORTIONAL SOLENOID

[76] Inventors: Kenneth W. Zeuner, 43 Red Fox Dr., New Hope, Pa. 18938; Steven K. Zeuner, 39 Larch Cir.; Thomas A. Zeuner, 230 Woodlake Dr., both of Holland, Pa. 18966

[21] Appl. No.: 669,111

[22] Filed: Nov. 7, 1984

[51] Int. Cl.[4] ..... H01F 7/08

[52] U.S. Cl. ..... 335/258; 335/262; 335/266

[58] Field of Search ..... 335/251, 255, 258, 260, 335/262, 266, 268

[56] References Cited

U.S. PATENT DOCUMENTS 3,735,302 5/1973 Eckert ..... 335/279 X
3,970,981 7/1976 Coors ..... 335/266
4,525,695 6/1985 Sheng et al. ..... 335/262
4,528,534 7/1985 Read ..... 335/262

*Primary Examiner*—George Harris
*Attorney, Agent, or Firm*—Ratner & Prestia

[57] ABSTRACT

A solenoid having a high degree of proportionality. A stationary pole is disposed within an electromagnetic coil and forms part of a flux path. An armature slides into and out of a bore of the pole and forms another part of the flux path. The armature has walls which define an axial recess formed in the armature face adjacent the pole. The armature walls have a cross-sectional thickness which decreases in a direction toward the bore. The walls of the pole bore have a cross-sectional thickness which decreases in a direction toward the armature. An air gap is formed between the decreasing thickness pole bore walls and armature walls which air gap remains substantially constant in the radial dimension as the armature slides.

11 Claims, 5 Drawing Figures

PROPORTIONAL SOLENOID

BACKGROUND OF THE INVENTION

A. Field of the Invention

This invention relates to the field of solenoids for operating electro-hydraulic valve assemblies, and specifically to solenoids having a high degree of proportionality.

B. Background Art

Solenoids having tapered pole pieces are well known in the prior art. Typical of these is the solenoid described in German Pat. No. 1,270,178 published June 12, 1968 wherein pole piece 10 has tapered projections 9 which define a bore containing armature 4. Armature 4 is of constant cross section, and when actuated, comprises spring 6 which is located external to the solenoid housing.

Similarly, U.S. Pat. No. 4,166,991 to Haner teaches various configurations for a pole piece in combination with a constant cross section armature.

U.S. Pat. No. 3,805,204 to Petersen teaches the use of an armature and pole piece having complementary extensions and indentations. Petersen attains a desired force profile by nesting his pole piece within a complementary armature, thus providing a variable air gap between them.

In contrast to Petersen, U.S. Pat. No. 3,381,250 to Weathers includes a complementary armature and pole piece wherein the conic face of the armature nests into a conic recess of the pole piece. Such a design also provides for a desired force profile by providing a varying air gap between the armature and pole piece. U.S. Pat. No. 3,735,302 (Eckert) also shows a complementary pole piece and armature set. Again, the conic pole piece mates with a complementary recess on the solenoid armature.

It is also well known to employ tapered pole pieces in double acting solenoids. U.S. Pat. Nos. 3,870,931 (Myers) and 3,900,822 (Hardwick et al) both teach the use of inwardly tapered pole pieces in combination with constant cross section armatures in double acting solenoids.

A major problem in the field of electromagnetic solenoids has been a lack of voltage-position proportionality. Such a lack of proportionality has necessitated the use of compensating arrangements of both electrical and mechanical types. These additional components have contributed to overall complexity and expense of solenoid systems and have also degraded system reliability. It is therefore an objective of the present invention to provide a solenoid having superior voltage-position proportionality.

SUMMARY OF THE INVENTION

A solenoid having a high degree of proportionality including an inwardly tapered ferromagnetic pole piece, a non-magnetic barrel, and a ferromagnetic armature having a conic indentation therein adapted to slide within the solenoid bore. Energization of an electromagnetic coil surrounding the bore creates attractive force between the tapered pole piece member and the conic section of the armature displacing the armature linearly against a counterspring.

DETAILED DESCRIPTION OF THE INVENTION

Figure 1:
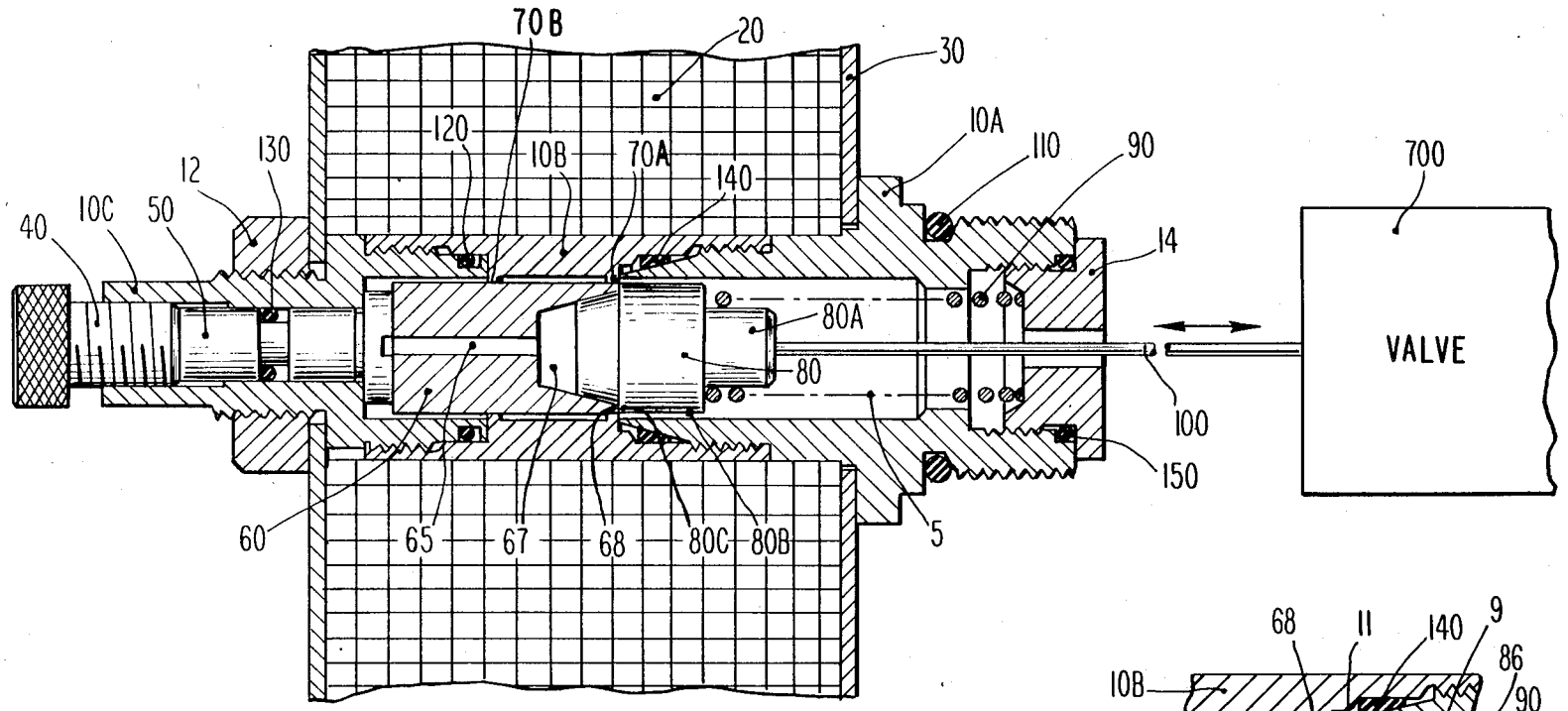
FIG. 1 is a partial cross-sectional view of the single acting proportional solenoid of the present invention.

Referring now to FIG. 1, there is shown in cross section the single-acting proportional solenoid which comprises the present invention. The solenoid body is comprised of three sections: magnetic pole piece 10A, non-magnetic 10B, and magnetic barrel 10C. Barrel 10C and pole piece 10A are threadedly connected to the inner threads of sleeve 10B and, as a connected unit, define solenoid bore 5. The solenoid body is made leak resistant by use of resilient seals 120 and 140 at the point of sleeve 10B which extend into barrel 10C and pole piece 10A respectively.

Magnetic barrel 10C is threaded both internally and externally. The external threads of barrel 10C receive coil retaining nut 12 while the internal left end threads of barrel 10C receive manual override screw 40 which actuates manual override plunger 50 positioned within a reduced diameter (with respect to bore 5) inner chamber of barrel 10C and made leak resistant by seal 130.

Mounted in surrounding relationship to solenoid body 10 is a coil 20 and coil frame 30. Coil frame 30 is supported on solenoid body 10 by a wide outer shoulder on magnetic pole piece 10A and by coil retaining nut 12.

Slideably mounted within solenoid bore 5 are armature 60 and non-magnetic actuator wire carrier 80. Armature 60, which is of constant external diameter is in sliding contact with friction reducing annular ridges 70A and 70B formed on the inner surface of sleeve 10B. Armature 60 is formed of a ferromagnetic material while carrier 80 is formed of a non-magnetic material such as aluminum, or plastic.

Figure 2:
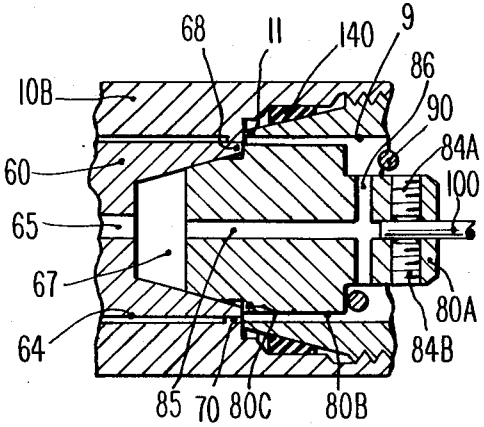
FIG. 2 is a cross-sectional view of the armature to pole piece overlap region of the proportional solenoid of the present invention.

Referring now to FIG. 1 and FIG. 2 taken together, carrier 80 includes a carrier stem 80A of a lesser diameter than the flange 80B of carrier 80. Stem 80A has set screws 84A and 84B which retain an axially extending actuator wire 100 within carrier bore 85. Surrounding both stem 80A and actuator wire 100, and engaging a shoulder between stem 80A and flange 80B, is a spring 90 which provides counter balancing force to that generated by movement of armature 60 in response to energization of coil 20. Spring 90 is retained within solenoid bore 5 by spring stop and end cap 14 which is threadedly retained within an end inner chamber in magnetic pole piece 10A. The spring stop to pole piece joint is made leak resistant by use of resilient seal 150. Actuator wire 100 extends through a central opening in spring stop 14 and is connected in a known manner adapted to actuate a valve, 700.

Carrier 80 also has a conic section 80C on the side of carrier flange 80B remote from carrier stem 80A. Carrier 80 has a longitudinal bore 85 and a stem transverse bore 86 which permit the passage of hydraulic fluid through the carrier. Carrier conic section 80C and its shoulder formed with flange 80B are adapted to be received by a complimentary truncated conic face 67 of armature 60.

Armature 60 contains a longitudinal bore 65. Face 67 is an outwardly directed conic depression in armature 60 extending toward carrier 80 and pole 10A. Face 67 is defined by the decreasing cross-sectional thickness of armature limb 68 in the direction of carrier 80 and pole bore 5. Armature 60 also has outer cylindrical face 64.

Magnetic pole piece 10A has inner face 9 which partially defines solenoid bore 5. Pole 10A also has angled pole face 11. The angle of pole face 11 with respect to the longitudinal axis of bore 5 is defined by its decreasing cross-sectional thickness in a direction toward sleeve 10B and armature 60.

Figure 3:
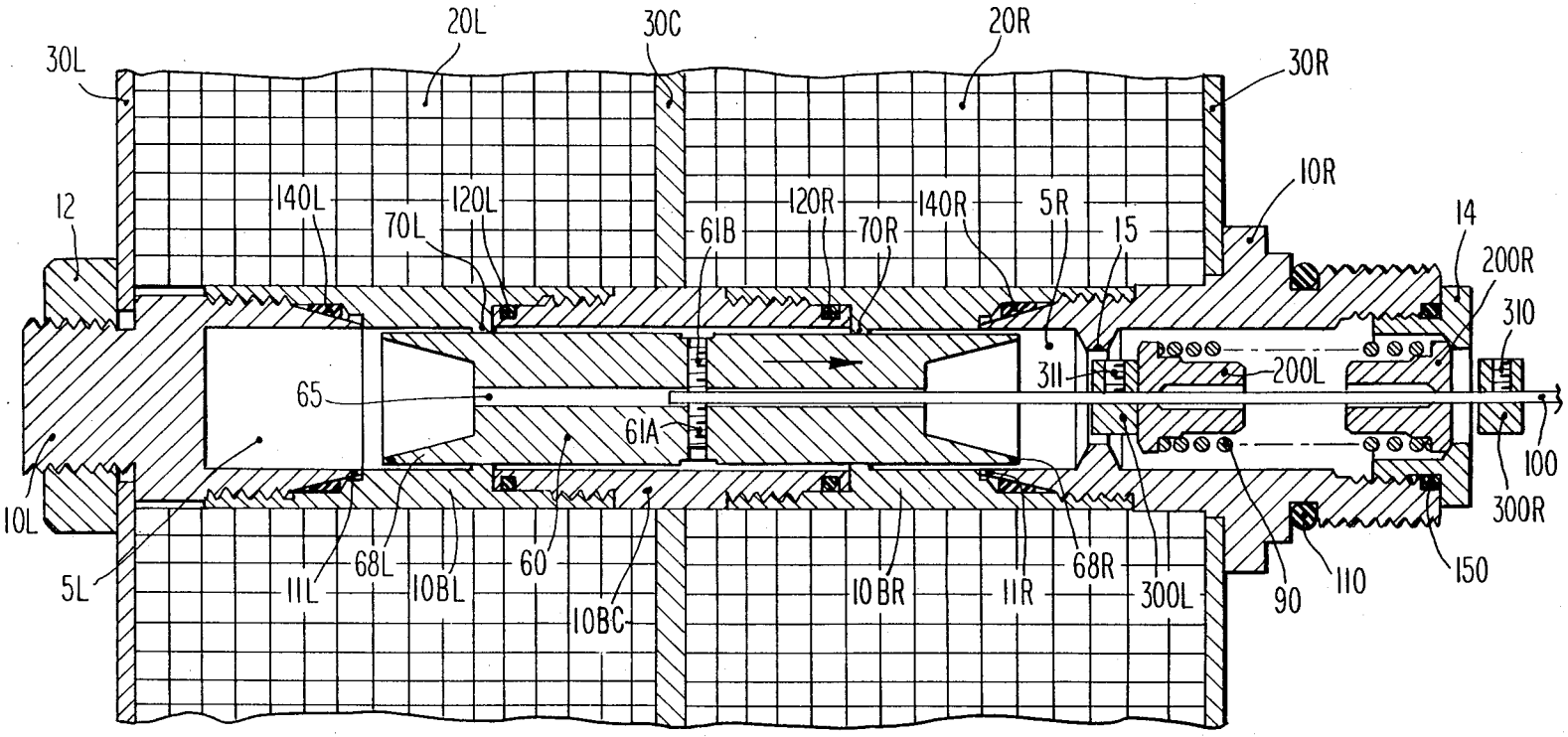
FIG. 3 is a cross-sectional view of the double acting proportional solenoid of the present invention.

As depicted in FIGS. 1–3, the angle formed between faces 9 and 11 of pole piece 10A is approximately equal to that formed between faces 64 and 67 of armature 60. As shown these angles are about 15° respectively.

Both armature limb 68 and pole piece 10A are constructed of materials having similar ferromagnetic properties. As armature 60 slides within pole piece 10A for every position of the armature, a region of overlap develops which contains approximately equal masses contributed by armature 60 and pole piece 10A.

In operation, armature 60 slides within bore 5 while maintaining a constant radial distance from conical face 11 of magnetic pole piece 10A. A path of magnetic flux derived from energization of coil 20 causes attraction between armature limb 68 and pole piece 10A drawing armature 60 to the right toward spring stop 14 and into a compressive relationship with spring 90. Such movement axially displaces actuator wire 100. This displacement may be employed for control of any known type of hydraulic valve or other controlled assembly 700.

Referring now to FIG. 3, there is shown a double-acting embodiment of the present invention. Components having the same or similar function as those depicted in FIGS. 1 and 2 have been assigned common reference numbers. The double-acting solenoid comprises essentially a pair of single-acting solenoids placed in "back-to-back" relationship.

Two coils 20L and 20R are disposed to the left and right sides respectively of central coil frame member 30C. These coils are further supported by frame members 30L and 30R. Located within coils 20L and 20R is a solenoid body comprising left pole piece 10L, left non-magnetic sleeve 10BL, central non-magnetic sleeve 10BC, right non-magnetic sleeve 10BR, and right pole piece 10R. All of these elements are threadedly joined and made leak-proof with resilient seals 140L, 140R, 120L, and 120R. Pole piece 10R supports coil frame 30R on a peripheral flange while pole piece 10L is externally threaded to accept coil retaining nut 12 which locks the entire coil frame and coil assembly into position about the solenoid body.

Centrally disposed within the solenoid body is a solenoid bore 5 comprising a left end 5L and a right end 5R. Armature 60 is adapted to slide axially within the armature bore sliding into and out of bore ends 5L and 5R in response to an applied voltage in either of the coils 20L and 20R.

Armature 60 includes axial armature bore 65 and also has a pair of centrally located set screws 61A and 61B for retaining actuator wire 100 within bore 65. Armature 60 further has a pair of truncated conic faces defined by tapered armature limbs 68L and 68R. These tapered faces have identical construction to that of limb 68 as described in FIGS. 1 and 2. Similarly, pole pieces 10L and 10R have inwardly tapered pole faces 140L and 140R which are constructed similarly to pole face 140 as described with reference to FIGS. 1 and 2.

Counter balancing spring force is provided by spring 90 which is retained between spring stops 200L and 200R. These spring stops are provided with axial bores to permit free passage of actuator wire 100 therethrough. Actuator wire 100 is provided with stops 300L and 300R each having a set screw 311 and 310 respectively. Finally, bore 5R is provided with an end cap 14 which is threadedly assembled into pole piece 10R. End cap 14 has a reduced diameter opening to permit passage therethrough of stop 300R and prevent passage of spring stop 200R. Similarly, pole piece 10R is provided with an annular shoulder 15 which is sized to allow passage of stop 300L and prevent passage of spring stop 200L.

FIG. 3 depicts the double-acting solenoid of the present invention as it would appear with coil 20R energized. Armature 60 is displaced to the right from its resting point, thereby displacing actuator wire 100 to the right. This displacement, in turn, moves stop 300L into contact with spring stop 200L thereby compressing spring 90. Spring 90 thereby displaces spring stop 200R into contact with end cap 14 and provides a counter balancing force to the electromagnetic attraction between armature 60 and pole piece 10R.

It will be readily appreciated by one skilled in the art that a similar symmetric action of opposite direction may be achieved by energizing only coil 20L. Such an opposite displacement of armature 60 would cause a compression of spring 90 by the action of stop 300R against spring stop 200R and the corresponding abutment of spring stop 200L against flange 15.

Contrary to the practices of the prior art which employed a pair of springs to counterbalance the actuation force of the armature, the present invention employs only one spring 90. By proper adjustment of stops 300L and 300R, a symmetric counterbalancing force is available. Because both actuation directions compress spring 90, all variations in voltage-position proportionality due to the asymmetry of springs used in the prior art is eliminated.

Figure 4:
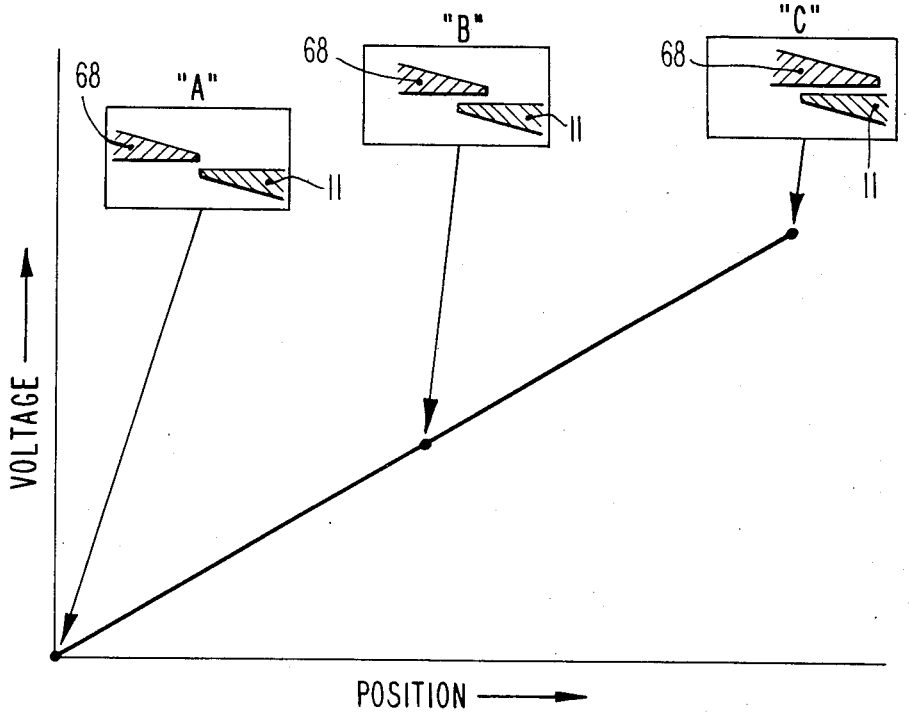
FIG. 4 is a pictorial and graphic representation of the position to voltage relationship exhibited by the single acting proportional solenoid of the present invention.

Referring now to FIG. 4 there is shown a schematic and graphic representation of the relationship between position and voltage in the single-acting embodiment of the present invention depicted in FIGS. 1 and 2. As shown in FIG. 4, position A depicts the axial position of armature 60 when no voltage is applied to coil 20. As depicted schematically, armature limb 68 and pole face 11 do not overlap in this unenergized position.

As shown at position B, an intermediate voltage applied to coil 20 causes an intermediate displacement and concomitant intermediate overlap between limb 68 and pole face 11. The force generated in this position is proportionately greater due to the increased ferromagnetic mass in the armature limb to pole face overlap region.

As depicted at FIG. C, a maximal voltage applied to coil 20 brings about a maximal displacement of armature 60. As can be seen in the schematic representation at C, a maximum armature limb to pole face overlap is achieved.

As will be apparent from all of the foregoing figures, the radial alignment between the solenoid armature and pole faces is constant, thereby creating a constant air gap. This constant radial alignment aids in the proportionality achieved in the present invention.

Figure 5:
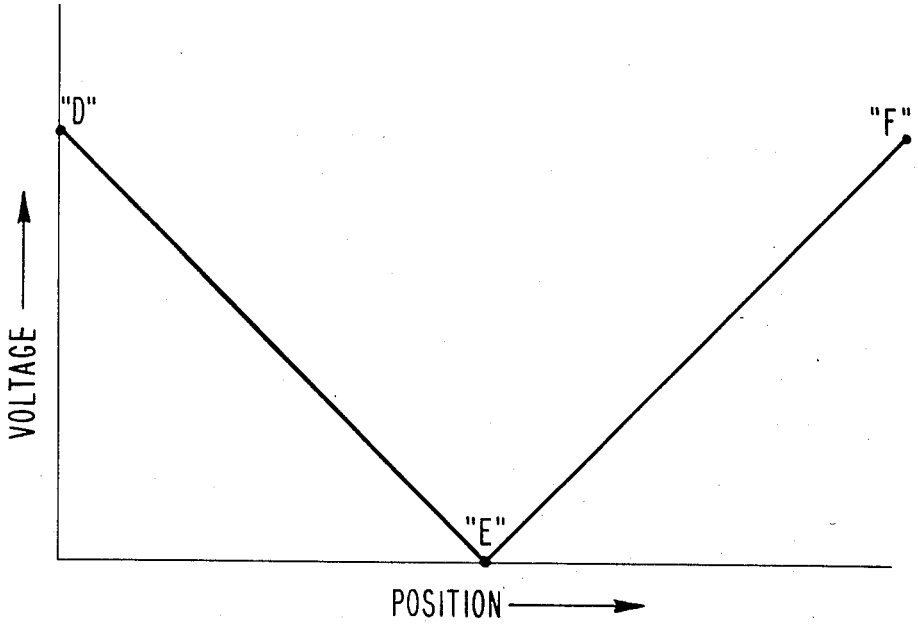
FIG. 5 is a graphic representation of the position voltage relationship exhibited by the double acting solenoid of the present invention.

Referring now to FIG. 5 there is shown a graphic representation of the voltage-to-position relationship of the double-acting solenoid of the present invention. As depicted at point D, coil 20L is energized to its maximum extent, thereby displacing armature 60 leftward to the maximum extent of its travel.

Position E in FIG. 5 demonstrates the position of armature 60 when neither coil 20L nor coil 20R is energized. In this neutral resting position, the axial position of armature 60 is governed solely by adjustment of stops 300L, 300R, and set screws 61A and 61B.

Position F in FIG. 5 depicts the axial position of armature 60 when only coil 20R is energized to its maximum extent. This position is the most rightward extention achievable within the double-acting embodiment of the present invention.

As will be appreciated by those skilled in the art, the angles employed for armature limbs and pole face angles in the preferred embodiment of the present invention are 15°. However, other suitable angles may be employed in order to vary the operational parameters of the solenoid assembly. Specifically, differing angles may provide differing force curves, strokes, and/or efficiencies.

In addition, it will be understood by those skilled in the art that excitation of the solenoid coils taught herein may be accomplished by any suitable means including but not limited to direct current, alternating current, and modulated currents such as pulse width modulated signals.

Finally, it will be appreciated by those skilled in the art that the solenoids of the present invention may be employed to provide variable linear inputs to diverse types of devices including but not limited to hydraulic spool valves, poppit valves, and other types of control equipment.

Having fully described our invention in such a manner as to allow one skilled in the art to which it pertains to make and use it, we claim as our invention:

1. A solenoid comprising
electromagnet coil means;
a stationary pole disposed within said coil and forming a part of a flux path;
said pole having a bore defined by walls;
an armature adapted to slide into and out of said said pole bore and forming another part of said flux path;
said armature having armature walls defining an axial recess formed in the face of the armature adjacent said pole;
said armature walls having a cross-sectional thickness which decreases in a direction toward said bore, said pole bore walls having a cross-sectional thickness which decreases in a direction toward said armature;
an air gap formed between said pole bore walls of decreasing thickness and said armature walls of decreasing thickness, said air gap being substantially constant in the radial dimension during said sliding of said armature.

2. A solenoid comprising
elecromagnet coil means;
a stationary pole disposed within said coil and forming a part of a flux path;
said pole having a bore defined by walls;
an armature adapted to slide into and out of said said pole bore and forming another part of said flux path;
said armature having armature walls defining an axial recess formed in the face of the armature adjacent said pole;
said armature walls having a cross-sectional thickness which decreases in a direction toward said bore, said pole bore walls having a cross-sectional thickness which decreases in a direction toward said armature; and
all air gaps formed between said pole bore walls and said armature walls being substantially constant in the radial dimension during said sliding of said armature into and out of said pole bore.

3. The solenoid of claim 1 or claim 2, wherein said solenoid comprises means completing the flux path around said coil.

4. The solenoid of claim 1 or claim 2 wherein said pole bore walls have a cylindrical inner surface with a diameter which exceeds the diameter of the outer surface of said armature.

5. The solenoid of claim 4 wherein said pole bore walls have a cylindrical inner surface which surrounds the maximum outer diameter of the outer surface of said armature.

6. The solenoid of claim 1 wherein all air gaps formed between said pole bore walls and said armature walls being substantially constant in the radial dimension during said sliding of said armature into and out of said pole bore.

7. A solenoid comprising
electromagnet coil means;
a stationary pole disposed within said coil;
said pole having a cylindrical bore therein;
a moveable armature disposed within said coil and adapted to slide into and out of said pole bore;
said pole and said armature each forming a flux path having substantially equal magnetic mass contribution to the magnetic mass within a flux path region defined by said pole and said armature;
the amount of magnetic mass in said flux path region being related to the axial position of said armature with respect to said pole, with said magnetic mass increasing in both said armature and said pole bore as said armature slides into said pole bore;
an air gap formed between that portion of said pole bore walls and said armature walls which contributes to the increasing magnetic mass within the flux path region, said air gap being substantially constant in the radial dimension during said sliding of said armature.

8. A double-acting solenoid comprising electromagnet coil means;
a pair of stationary poles each disposed within said coil and forming part of a flux path;
means completing said flux path around each of said coils;
said poles having bores defined by walls;
an armature adapted to slide alternately into and out of both of said bores and forming another part of said flux path;
said armature having armature walls defining a pair of axial recesses formed in the faces of the armature adjacent said poles;
said armature walls in each of said recesses having a cross-sectional thickness which decreases in a direction away from the center of said armature and toward said respective bores, said pole bore walls having a cross-sectional thicknesses which decrease in a direction toward said armature walls in each of said recesses;

an air gap formed between said pole bore walls of decreasing thickness and said armature walls of decreasing thickness, said air gap being substantially constant in the radial dimension during said sliding of said armature.

9. The solenoid of claim 3 wherein the amount of magnetic mass in said flux path region is linearly related to the axial position of said armature within said coil.

10. The solenoid of claim 1 or claim 6 wherein said armature is manually actuable to slide into said pole bore.

11. The double acting solenoid of claim 8 further comprising a single spring connected to said armature tending to bias said armature to a position substantially equidistant from said poles.

* * * * *